US007383650B2

(12) United States Patent
Duesler

(10) Patent No.: US 7,383,650 B2
(45) Date of Patent: Jun. 10, 2008

(54) METHOD AND APPARATUS FOR BEVERAGE MERCHANDISING

(76) Inventor: Brad Duesler, 2301 Middleton Beach Rd., Middleton, WI (US) 53562

( * ) Notice: Subject to any disclaimer, the term of this patent is extended or adjusted under 35 U.S.C. 154(b) by 540 days.

(21) Appl. No.: 10/679,705

(22) Filed: Oct. 3, 2003

(65) Prior Publication Data

US 2004/0118022 A1 Jun. 24, 2004

Related U.S. Application Data

(60) Provisional application No. 60/416,153, filed on Oct. 4, 2002.

(51) Int. Cl.
*G09F 11/04* (2006.01)

(52) U.S. Cl. ..... 40/310; 40/324

(58) Field of Classification Search ..... 40/310, 40/311, 324; 63/15.5, 15.7, 40, 63
See application file for complete search history.

(56) References Cited

U.S. PATENT DOCUMENTS

| | | | | | |
|---|---|---|---|---|---|
| 97,669 | A * | 12/1869 | McMillian | 40/306 |
| 343,688 | A * | 6/1886 | Barney | 40/660 |
| 1,262,788 | A * | 4/1918 | Heidenreich | 40/334 |
| 3,996,879 | A * | 12/1976 | Walton | 116/308 |
| 4,538,430 | A * | 9/1985 | Parks | 63/15.6 |
| 4,951,596 | A * | 8/1990 | Wallace, Jr. | 116/321 |
| 5,260,914 | A * | 11/1993 | Roberts | 368/10 |
| 6,412,632 | B1 * | 7/2002 | Shrader | 206/459.1 |

* cited by examiner

*Primary Examiner*—Cassandra Davis
(74) *Attorney, Agent, or Firm*—Foley & Lardner LLP

(57) ABSTRACT

A method and apparatus for beverage merchandising including an annular collar for the neck of a beverage decanter, such as a coffee carafe, which is able to display text information or pictures along its outside surface. The display of text information or pictures may be performed using a graphical insert, such as paper, inserted into a slot formed along the outside surface of the annular collar.

6 Claims, 5 Drawing Sheets

METHOD AND APPARATUS FOR BEVERAGE MERCHANDISING

CROSS-REFERENCE TO RELATED APPLICATION

This application claims the benefit of provisional patent application No. 60/416,153, filed Oct. 4, 2002, the disclosure of which is incorporated by reference.

FIELD OF THE INVENTION

The present invention relates generally to the field of food merchandising, and particularly to beverage merchandising.

BACKGROUND OF THE INVENTION

Merchandising methods and devices have grown increasingly sophisticated in response to evolving customer tastes and competition in crowded marketplaces. Methods and devices for merchandising beverages may increase sales of beverages and associated products by attracting consumers who may be passing by, such as in a gas station, convenience store, mall food court, or fast food store.

A variety of techniques have been developed for beverage merchandising. For example, it is common to place a sign, which may be handwritten or printed, on a stand near a coffeepot or beverage carafe. Some coffee pots are color coded to indicate, for example, whether the coffee in the pot is decaffeinated or regular. However, the practical value of these prior techniques is limited by real-world considerations such as information display capacity, durability, cost, cleanliness, appearance, and space requirements.

For these reasons, a method and apparatus for beverage merchandising including a information display which addresses the shortcomings of the prior art would be useful.

SUMMARY OF THE INVENTION

The present invention relates to a method and apparatus for merchandising beverages including an annular collar for the neck of a beverage decanter, such as a coffee carafe, which is able to display text information or pictures along its outside surface. The display of text information or pictures may be performed using a strip of sheet material, for example paper, inserted into a slot formed along the outside surface of the annular collar.

Such an annular collar does not consume any additional counter or display space, since the space around the neck of a beverage decanter is normally unused. A preferred embodiment of such an annular collar may be inexpensive to manufacture using a semi-rigid material, such as plastic, forming an annular collar which is durable, easy to clean, and attractive in appearance.

According to another aspect of the invention, a timer or other electronic device may display information which changes over time, for example the time a pot of coffee was brewed, the current time, news information, or the like.

Further objects, features, and advantages of the invention will be apparent from the following detailed description when taken in conjunction with the following drawings.

DETAILED DESCRIPTION OF THE INVENTION

Figure 1:
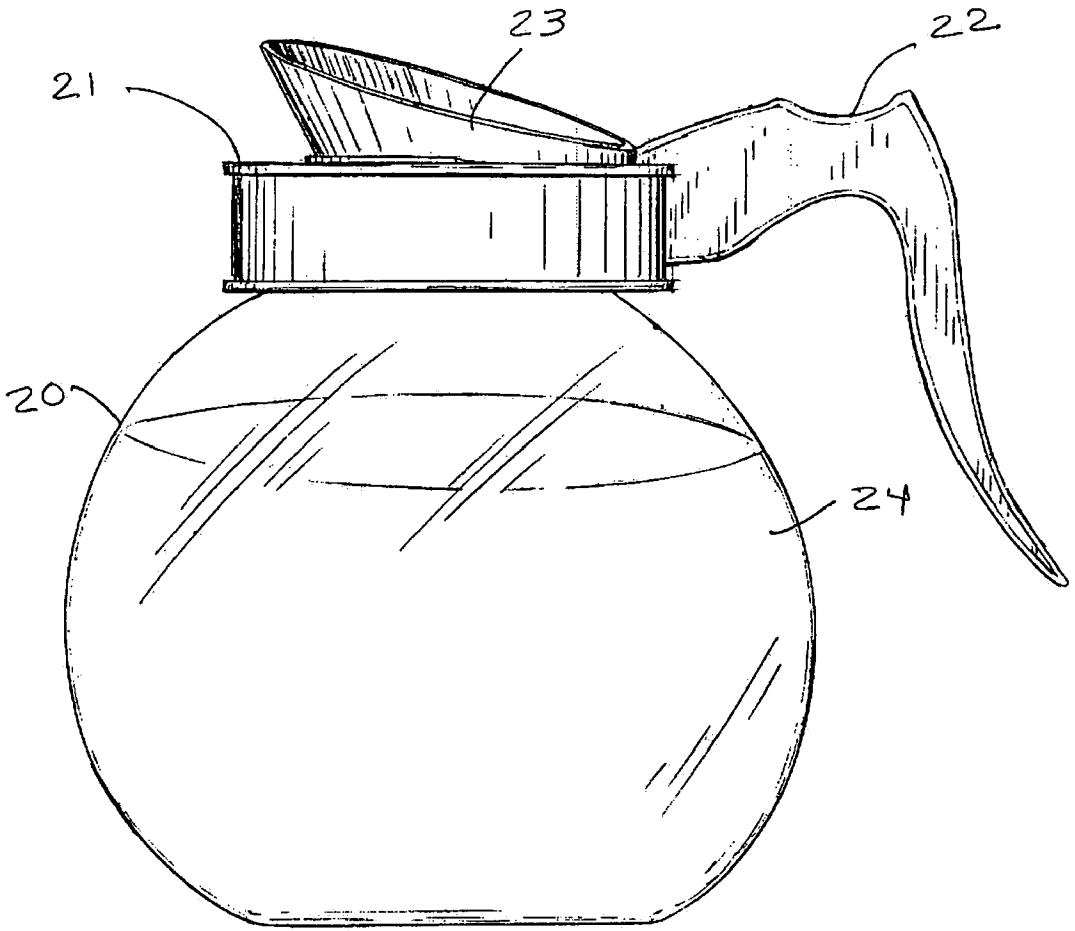
FIG. 1 is a side view of a beverage decanter bearing an embodiment of an annular collar for information display according to the invention.

With reference to the drawings, FIG. 1 shows a side view of a beverage decanter, indicated generally at 20, bearing a preferred embodiment of an annular collar for information display according to the invention, indicated generally at 21. The annular collar 21 is preferably shaped to snugly fit the neck 23 of the beverage decanter 20, and may include a gap 33 (not shown in FIG. 1) in the annular collar for a handle 22 of the beverage decanter 20. The beverage decanter 20 preferably contains a beverage 24, for example coffee.

Figure 2:
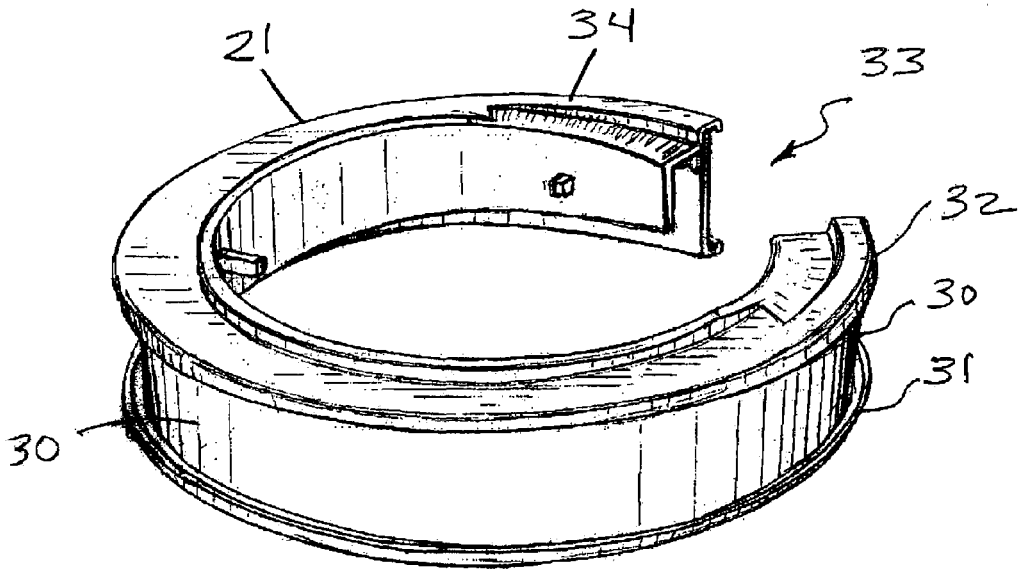
FIG. 2 is a front perspective view of the annular collar for information display of FIG. 1.
Figure 3:
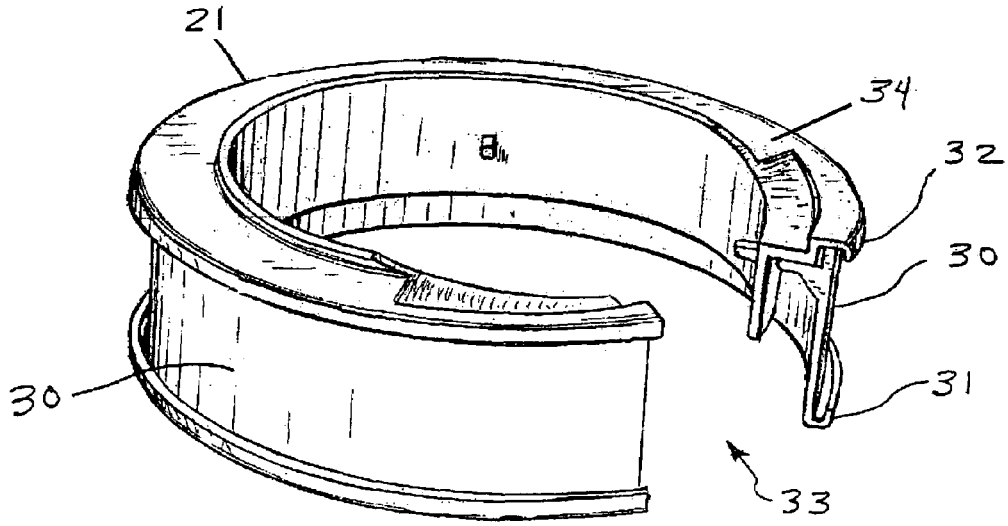
FIG. 3 is a rear perspective view of the annular collar for information display of FIG. 1.

FIGS. 2 and 3 show perspective views of the annular collar 21. The annular collar 21 has an information display surface 30, a lower lip 31, an upper lip 32, and an upper surface 34. A gap 33 in the annular collar may be provided, for example to receive the handle of a beverage decanter.

Figure 4:
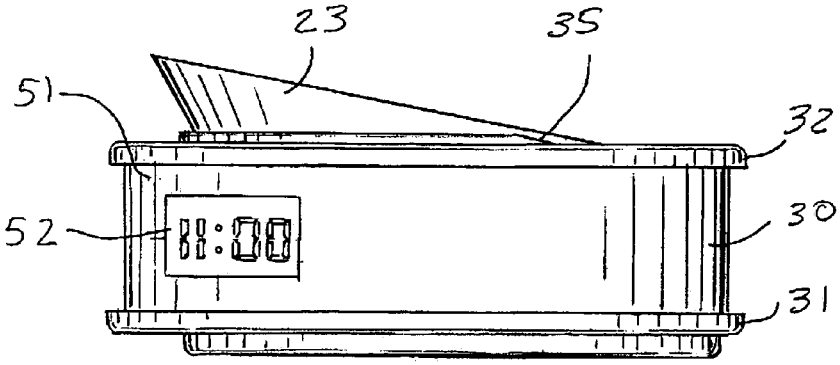
FIG. 4 is a side view of the neck of a beverage decanter bearing another embodiment of an annular collar for information display according to the invention.
Figure 5:
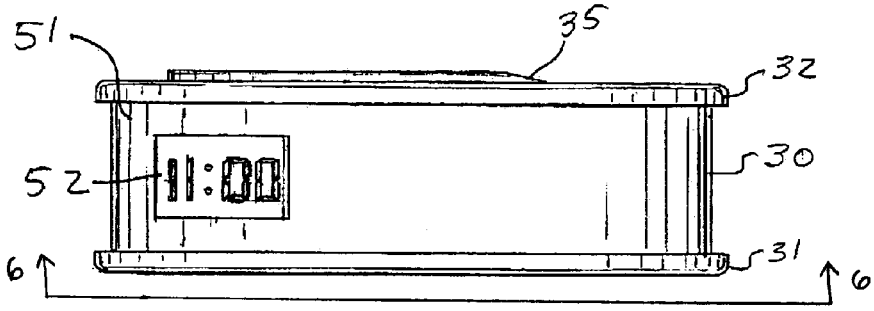
FIG. 5 is a side view of the annular collar for information display of FIG. 4.

FIG. 4 shows another embodiment of an annular collar 51 for information display according to the invention fitted around the neck 23 of a beverage decanter. The annular collar 51 preferably has a recessed area 35 which allows the annular collar 51 to fit more closely when the neck 23 of the beverage decanter is tapered. FIG. 5 provides the same view as FIG. 4 without the beverage decanter.

As shown in FIGS. 4 and 5, an annular collar 51 according to the invention may include an alphanumeric display 52, for example a liquid crystal display (LCD) or light emitting diode display (LED) or other display capable of displaying information which changes with time, such as the time a pot of coffee was brewed, the current time of day, the date, news, or other information. The alphanumeric display 52 can be used to present information, for example to attract and retain consumers in the vicinity of the annular collar 51, thereby increasing the likelihood that such consumers will make a purchase.

Figure 6:
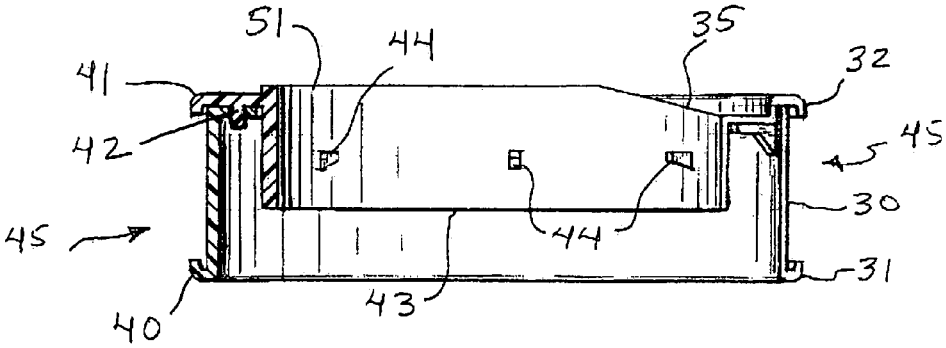
FIG. 6 is a cross-sectional view of the annular collar for information display of FIG. 5 taken along the line 6-6 thereof.

The cutaway view of FIG. 6 shows that the annular collar 51 for information display according to the invention may be formed of an upper piece 41 and a lower piece 40, which may be bonded together, for example using one or more heat stakes 42. The upper piece 41 and the lower piece 40 are preferably made of a durable, flexible material, for example thermoplastic formed using an injection molding process. As best shown in FIG. 6, the upper piece 41 may include the upper lip 32, the recessed area 35, and an inside lower edge 43, while the lower piece may include the lower lip 31 and the information display surface 30. The upper piece 41 may optionally include one or more spacers 44, which may be trimmed to allow the annular collar 51 to fit beverage decanters having necks of various sizes.

As best shown in the cutaway view of FIG. 6, the upper lip 32, the information display surface 30, and the lower lip 31 form a slot, indicated generally at 45. A graphic insert 46 (not shown in FIG. 6), for example paper, bearing printed text or pictures may be inserted into the slot 45, to indicate, for example, the type, brand, or flavor of beverage contained in the decanter. In a preferred embodiment, the upper lip 32 and the lower lip 31 retain the graphic insert 46 in the slot 45.

Figure 7:
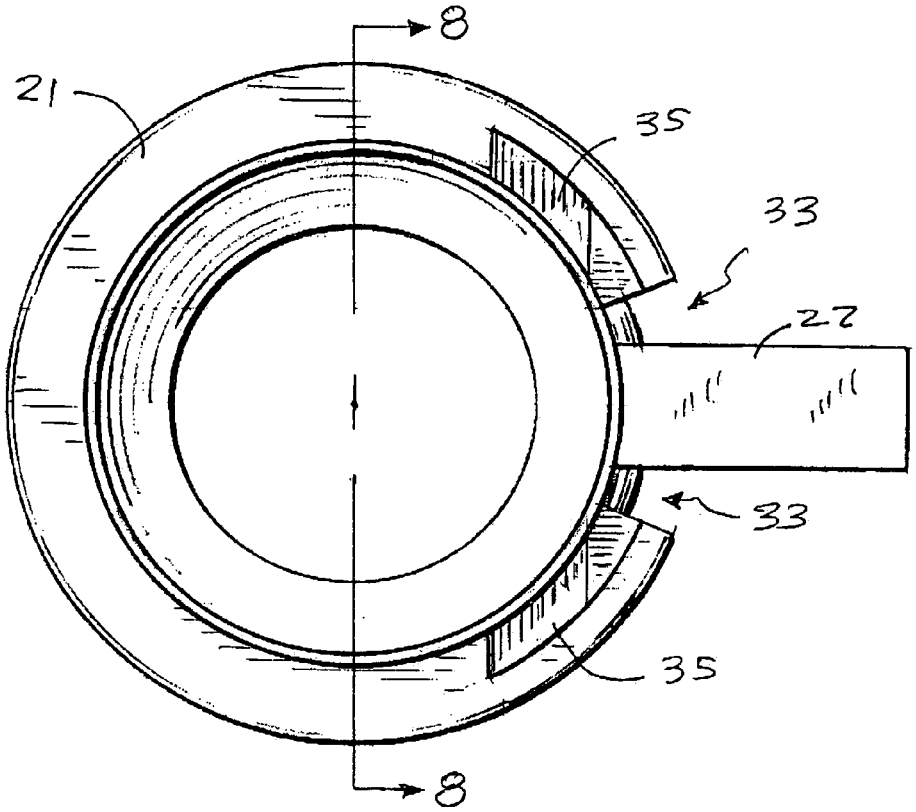
FIG. 7 is a top view of a beverage decanter bearing the annular collar of FIG. 1.

FIG. 7 shows a top view of a beverage decanter bearing an annular collar 21 of FIG. 1. As shown in FIG. 7, the handle 22 of the decanter 20 may extend through the gap 33 of the annular collar 21. Recessed areas 35 may be provided to allow the annular collar 21 to fit beverage decanters having tapered necks.

Figure 8:
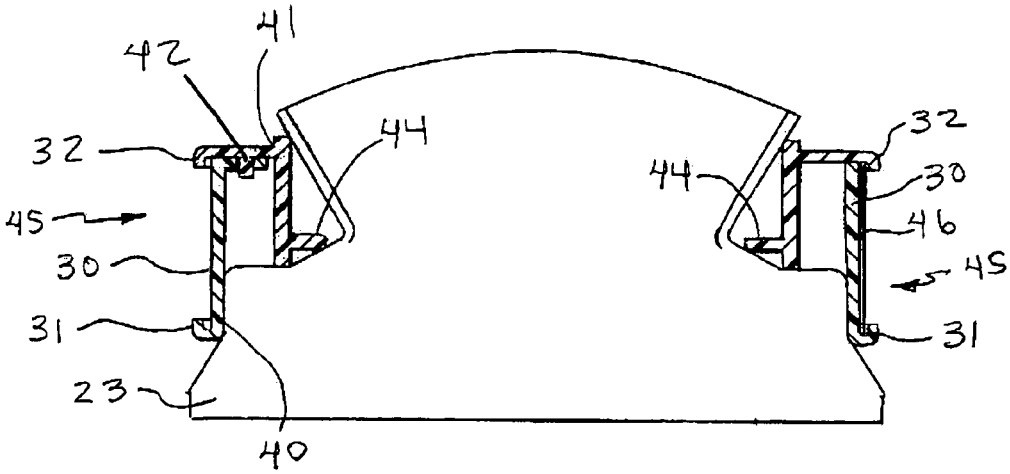
FIG. 8 is a cross-sectional view of the beverage decanter bearing an annular collar of FIG. 7 along the line 8-8 thereof.
Figure 9:
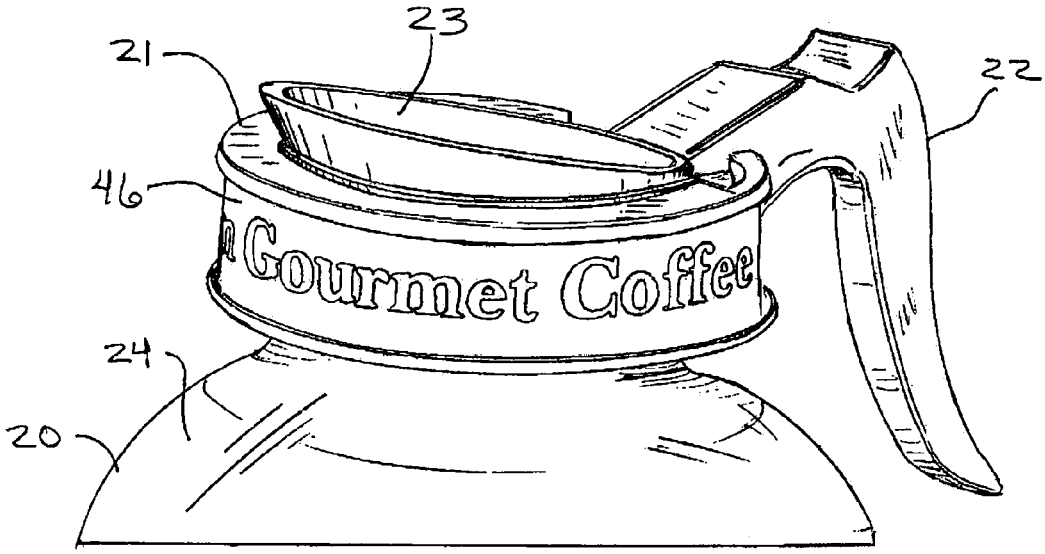
FIG. 9 is a perspective view of the annular collar for information display of FIG. 1 including a graphic insert.

FIG. 8 shows a cross-sectional view of a beverage decanter bearing an annular collar 21 for information display according to the invention. FIG. 9 is a perspective view of the annular collar 21. As shown in FIGS. 8 and 9, a graphic insert 46 may be inserted into the slot 45, to provide information on the information display area 30.

Figure 10:
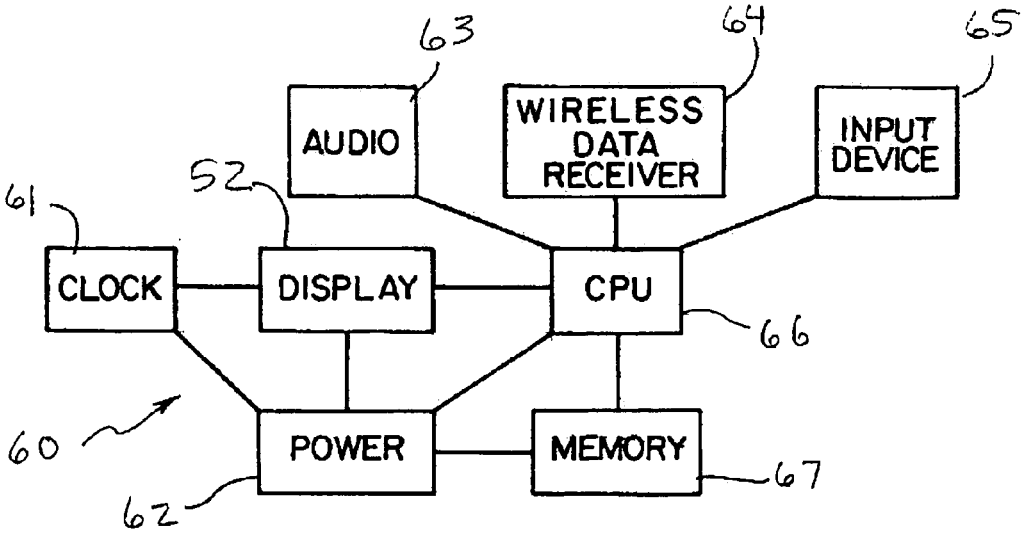
FIG. 10 presents a block diagram of exemplary circuitry for use in an annular collar for information display according to the invention.

FIG. 10 presents a block diagram of exemplary circuitry, indicated generally at 60, for use in an annular collar for information display according to the invention. The exemplary circuitry 60 may include clock circuitry 61, for example a quartz clock circuit of the type used in wristwatches or household timers. The exemplary circuitry 60 may include a power source 62, for example a battery or solar cell. The exemplary circuitry 60 may include one or more user interface devices, for example one or more audio devices 63, for example a speaker and amplifier of the types used in portable electronic devices, one or more alphanumeric displays 52, and one or more user input devices 65, for example a pushbutton switch used to reset a timer when a fresh pot of coffee is brewed. The exemplary circuitry 60 may also include computer circuitry, for example a central processing unit (CPU) 66, memory 67, for example random access memory or non-volatile memory such as an EPROM or EEPROM, and a wireless data receiver 64, for example an 802.11b network interface device that can be used, for example, to receive news information.

There are various possibilities with regard to alternative embodiments and methods including an annular collar for information display according to the invention.

For example, the annular collar may include a timer or other electronic display in order to indicate, for example, the time the beverage was brewed, current events or news, prices or promotions relating to the beverage or related products such as newspapers or pastries, or other information.

Similarly, the annular collar may be formed in other constructions. For example, the annular collar may be formed of more than two pieces, or extruded as a single piece.

It is understood that the invention is not confined to the embodiments set forth herein as illustrative, but embraces all such forms thereof as come within the scope of the following claims.

What is claimed is:

1. An apparatus for merchandising beverages comprising a collar forming at least a portion of an annulus, whereby the collar may be fitted around the neck of a beverage decanter, the collar having an upper end connected to an upper lip and a lower end connected to a lower lip, whereby the collar is adapted to receive a graphic insert, and further comprising at least one alphanumeric display mounted to the collar, whereby information that changes with time may be displayed on the alphanumeric display, and further comprising at least one clock circuitry mounted to the collar and operatively connected to the alphanumeric display, whereby time information may be displayed on the alphanumeric display.

2. An apparatus for merchandising beverages comprising a collar forming at least a portion of an annulus adapted to fit on a neck of beverage decanter, the collar having an information display surface, an inner surface facing opposite the information display surface, an upper end and a lower end, wherein the collar includes at least two spacers extending inwardly from the inner surface.

3. A beverage decanter comprising a decanter with a neck and an apparatus for merchandising beverages disposed around the neck, the apparatus comprising a collar forming at least a portion of an annulus adapted to fit on a neck of a beverage decanter, the collar having an information display surface, an inner surface facing opposite the information display surface, an upper end and a lower end, wherein the collar includes at least one spacer extending inwardly from the inner surface.

4. The beverage decanter of claim 3 wherein the decanter is a coffee pot.

5. The beverage decanter of claim 3, wherein the collar forms a portion of an annulus with a gap.

6. A method of merchandising a beverage comprising mounting an apparatus on the neck of a beverage decanter, the apparatus comprising a collar forming at least a portion of an annulus adapted to fit on a neck of a beverage decanter, the collar having an information display surface, an inner surface facing opposite the information display surface, an upper end and a lower end, wherein the collar includes at least one spacer extending inwardly from the inner surface.

* * * * *